US008430682B2

(12) United States Patent
Liao

(10) Patent No.: US 8,430,682 B2
(45) Date of Patent: Apr. 30, 2013

(54) ELECTRICAL CONNECTOR HAVING CONTACT TERMINALS WITH DEFLECTIVE ARMS FACING EACH IN TWISTED MANNER

(75) Inventor: Fang-Jwu Liao, Tu-Cheng (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 206 days.

(21) Appl. No.: 12/972,558

(22) Filed: Dec. 20, 2010

(65) Prior Publication Data

US 2011/0151723 A1 Jun. 23, 2011

(51) Int. Cl.
*H01R 4/50* (2006.01)
*H01R 13/625* (2006.01)

(52) U.S. Cl.
USPC ..... 439/342

(58) Field of Classification Search ..... 439/660, 439/342, 682, 891, 856
See application file for complete search history.

(56) References Cited

U.S. PATENT DOCUMENTS 2,779,011 A * 1/1957 Deakin ..... 439/857
3,865,462 A * 2/1975 Cobaugh et al. ..... 439/748
5,290,181 A * 3/1994 Bixler et al. ..... 439/856
5,454,727 A * 10/1995 Hsu ..... 439/263
6,135,784 A 10/2000 Pei
6,155,860 A * 12/2000 Lemke et al. ..... 439/341
6,264,490 B1 * 7/2001 Lemke et al. ..... 439/342
6,699,055 B2 * 3/2004 Peng et al. ..... 439/342
6,824,414 B2 * 11/2004 Whyne et al. ..... 439/342
6,979,219 B2 * 12/2005 Scholz ..... 439/342
7,819,708 B2 * 10/2010 Ngo ..... 439/856
8,052,454 B2 * 11/2011 Polnyi ..... 439/342

* cited by examiner

*Primary Examiner* — Hae Moon Hyeon

(74) *Attorney, Agent, or Firm* — Wei Te Chung; Ming-Chieh Chang

(57) ABSTRACT

An electrical connector (100) adapted for electrically connecting an integrated circuit (IC) package comprises an insulative housing (1) and a plurality of contacts (2) received in the insulative housing (1), the contacts (2) each comprises a base portion (21), a pair of arms (22) extending upwardly from the top end of the base portion (21) and a solder portion (23) extending from the bottom end of the base portion (21), the base portion (21) defines a first plane (P1), said pair of arms (22) are located on opposite sides of the first plane (P1) and each comprises a contacting portion (223), the contacting portion (223) and the first plane form an acute angle.

20 Claims, 5 Drawing Sheets

ELECTRICAL CONNECTOR HAVING CONTACT TERMINALS WITH DEFLECTIVE ARMS FACING EACH IN TWISTED MANNER

BACKGROUND OF THE INVENTION

1. Field of the Invention

The present invention relates to an electrical connector, especially to an electrical connector having contacts with twisted deflective arm facing each other for electrically receiving pin leg therebetween.

2. Description of the Related Art

LIF (low insertion force) sockets are widely used in computers to electrically connecting an integrated circuit (IC) package to a circuit board. Accordingly, signal transmission between the two components is achieved.

A typical LIF socket generally comprises an insulative housing and a plurality of contacts disposed in corresponding passageways of the insulative housing respectively. The contacts each comprises a pair of arms with mating interfaces for contacting with a corresponding pin of the package, and a soldering pad opposite to the mating interfaces for contacting with the circuit board. Accordingly, an electrical connection is established between the package and the circuit board.

U.S. Pat. No. 6,135,784 issued to Pei on Oct. 24, 2000 discloses a conventional LIF socket. The LIF socket includes an insulative housing and a plurality of contacts disposed in corresponding passageways of the insulative housing respectively. The contacts each comprises a base, a pair of arms extending from two sides of the base, and a soldering pad extending from a bottom end of the base. The arms each comprises an extending arm extending from the base and a spring arm extending from a top end of the extending arm and bending inwardly. When the pins of the package are inserted into the corresponding pair of spring arms, the spring arms are forced to deflect away from each other, which enables the pins to contact with the contacting sections of the spring arms. Thus, an electrical connection is established between the package and the circuit board.

However, in the process of production, the arms of the contact will produce a great many of waste materials, which added the cost.

Hence, an improved electrical connector is required to overcome the disadvantages of the prior art.

SUMMARY OF THE INVENTION

An object of the invention is to provide an electrical connector having contacts with improved structure to save the material.

To achieve the above-mentioned object, an electrical connector adapted for electrically connecting an integrated circuit (IC) package comprises an insulative housing and a plurality of contacts received in the insulative housing, the contacts each comprises a base portion, a pair of arms extending upwardly from the top end of the base portion and a solder portion extending from the bottom end of the base portion, the base portion defines a first plane, said pair of arms are located on opposite sides of the first plane and each comprises a contacting portion, the contacting portion and the first plane form an acute angle.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
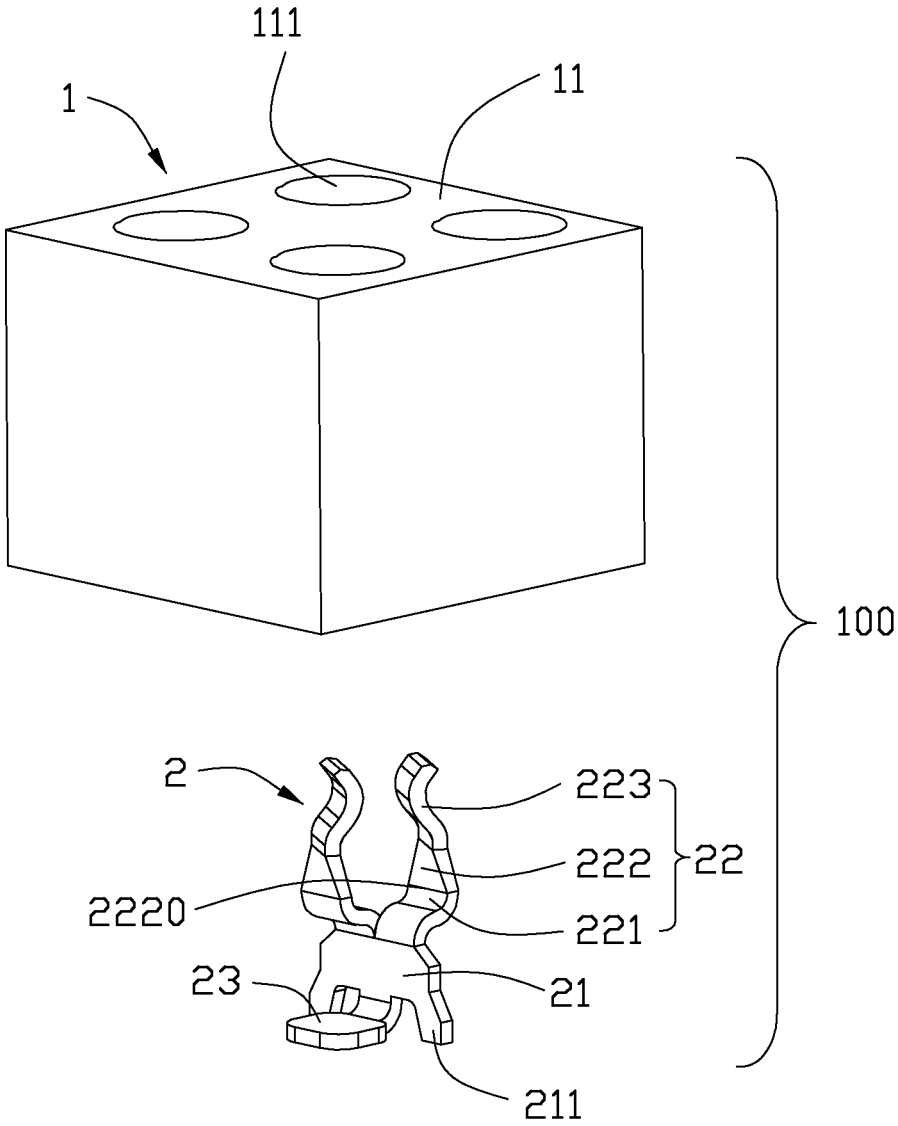
FIG. 1 an exploded, perspective view of an electrical connector in accordance with a preferred embodiment of the present invention.
Figure 4:
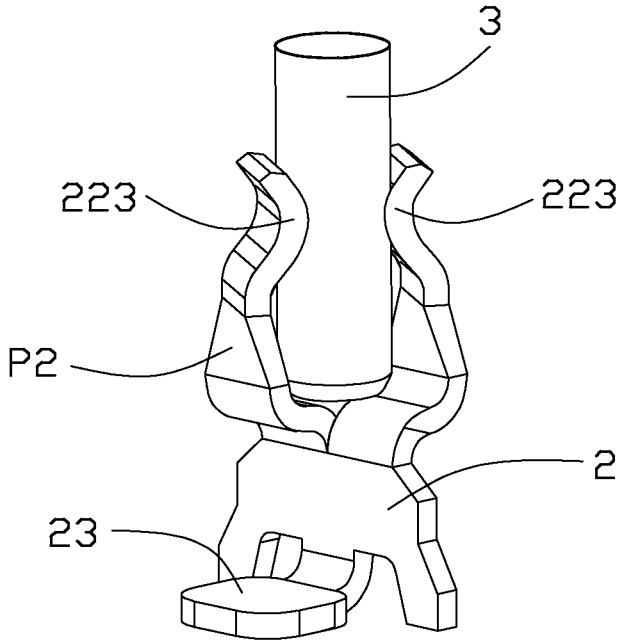
FIG. 4 is an isometric view of the contact shown in FIG. 1, showing a pin inserted into the arms of the contact.

Referring to FIG. 1 and FIG. 4, the electrical connector 100 is used to electrically connecting an integrated circuit (IC) package (not shown) with pins 3 to a circuit board (not shown). The electrical connector 100 comprises an insulative housing 1 and a plurality of contacts 2 received therein.

Figure 5:
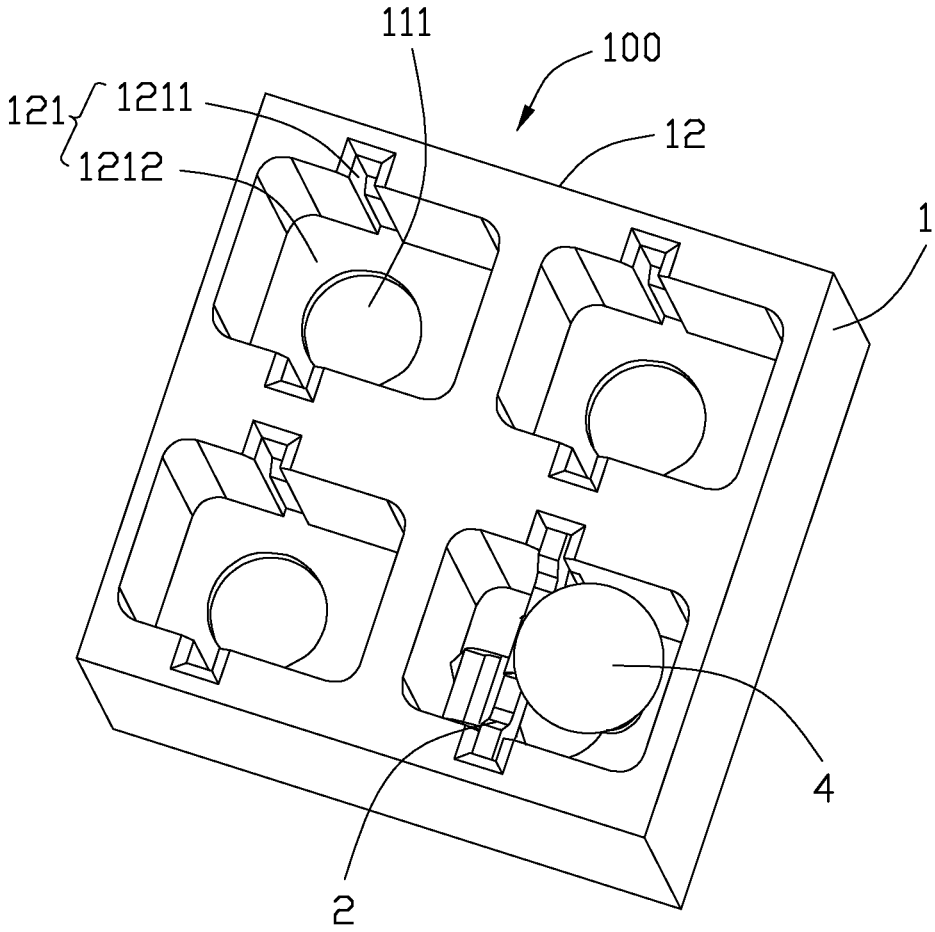
FIG. 5 is an assembled view of the electrical connector shown in FIG. 1, showing one contact with solder ball is assembled to the insulative housing.

Referring to FIG. 1 and FIG. 5, the insulative housing 1 is configured to a rectangular shape and comprises a top surface 11, a bottom surface 12 opposite to the top surface 11. The top surface 11 is used to support the package, and the bottom surface 12 is used to be assembled to the circuit board. The bottom surface 12 comprises a plurality of passageways 121 and the contacts 2 are received in the corresponding passageways 121 respectively. The passageways 121 each comprises a receiving space 1212 and a slot 1211 connecting with the receiving space 1212. The top surface 11 comprises a hole 111 connecting with the receiving space 1212.

Figure 2:
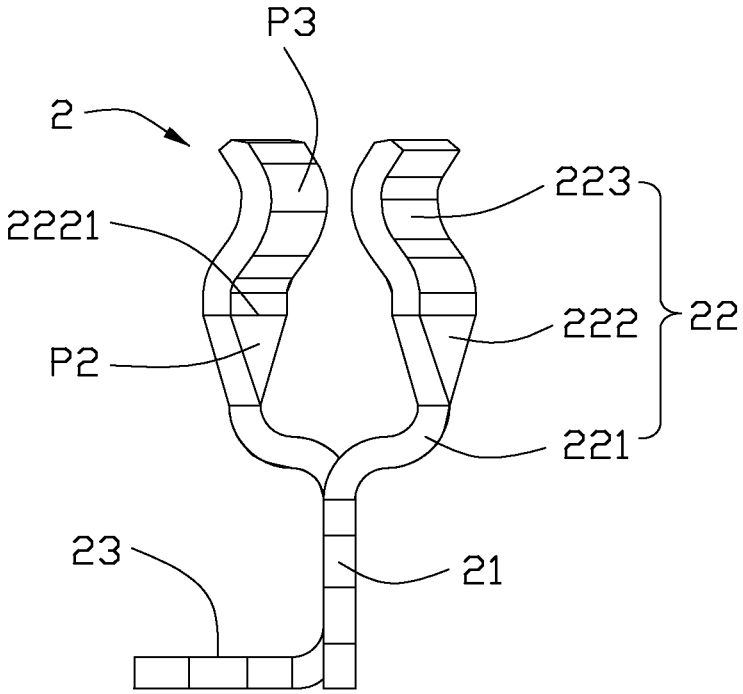
FIG. 2 is a side view of the contact shown in FIG. 1.
Figure 3:
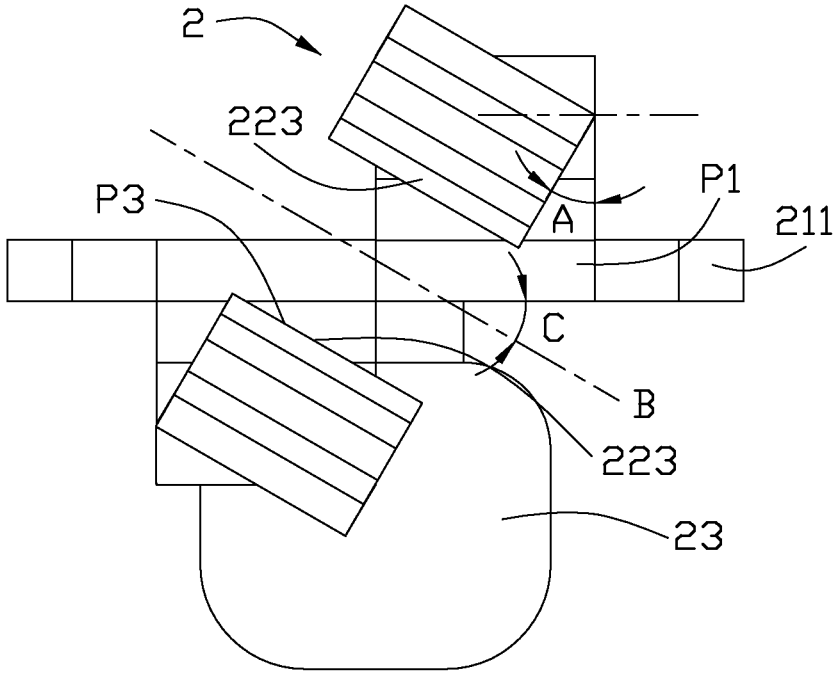
FIG. 3 is a top view of the contact shown in FIG. 1.

Referring to FIGS. 1-3, the contact 2 comprises a base portion 21, a solder portion 23 extending from the bottom end of the base portion 21 and a pair of spring arms 22 extending upwardly from the top end of the base portion 21. The base portion 21 comprises a pair of barbs 211. The two arms 22 are formed by split a metal sheet to two parts and then are bent to the two opposite sides of the base portion 21. The arms 22 each comprises a bending portion 221 extending curvedly from the base portion 21, a twist portion 222 extending upwardly from the bending portion 221 and a contacting portion 223 extending upwardly from the twist portion 222. The two ends of one contacting portion 223 are in line with the two ends of the other contacting portion 223. The base portion 21 defines a first plane P1 and the arms 22 are located on opposite sides thereof. Each contacting portion 223 defines a curved surface P3 at top end of the twist portion 222. The twist portions 222 are formed by rotating the arms 22 around the vertical axis in a twisting direction which is one of the clockwise direction and the counterclockwise direction and each defines a curve surface P2 whereby make the contacting portions 223 deviate from the first plane P1. The twisted angle A of each arms 22 is same with each other and is less than ninety degrees; while in this embodiment, the twisted angle A of each arms is further less than forty-five degrees. The bottom side of the twist portion 222 is paralleled with the base portion 21 and the top side of the twist portion 222 is paralleled with the contact portion 223. The top side of the twist portion 222 and the bottom side thereof form an acute angle. The solder portion 23 is configured to a plane shape and perpendicular to the base portion 21. The pair of arms 22 are symmetric with each other with regard to an oblique line B defining an angle C with regard to the retention section 21, and said angle C is also a twisted angle by each of arms 22.

FIGS. 4-5 showing the contacts 2 are assembled to the insulative housing 1. The contacts 2 are assembled to the insulative housing 1 from the bottom surface 12 of the insulative housing 1, the arms 22 are received in the receiving space 1212, the barbs 211 are received in the slot 1211 and interference with the insulative housing 1, then the contacts 2 are securely positioned in the insulative housing 1. The solder portion 23 is received in the receiving space 1212.

In used, the package is assembled to the top surface 11 of the insulative housing 1, the pin 3 of the package goes through the hole 111 to connect with the two contacting portions 223. Thus, an electrical connection is established between the package and the contacts 2.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An electrical connector adapted for electrically connecting an integrated circuit (IC) package, comprising:

an insulative housing; and a plurality of contacts received in the insulative housing, the contacts each comprising a base portion, a pair of arms extending upwardly from the top end of the base portion and a solder portion extending downwardly from the bottom end of the base portion, the base portion defining a first plane, said pair of arms being located on opposite sides of the first plane and each comprising a contacting portion, the contacting portions are paralleled with each other and each contacting portion and the first plane forming an acute angle from a top view.

2. The electrical connector as described in claim 1, wherein the two arms are formed by split a metal sheet to two parts and then are bent to opposite directions.

3. The electrical connector as described in claim 1, wherein the contacts also comprises a pair of twist portions formed by rotating the arms around a vertical axis and each defines a curve surface whereby make the contacting portions face to face with each other.

4. The electrical connector as described in claim 3, wherein the bottom side of the twist portion is paralleled with the base portion and the top side of the twist portion is paralleled with the contact portion, and wherein the top side of the twist portion and the bottom side form an acute angle.

5. The electrical connector as described in claim 1, wherein each arm comprising a bending portion extending curvedly from the base portion and a twist portion extending upwardly from the bending portion, wherein the contacting portion connects the twist portion.

6. The electrical connector as described in claim 1, wherein opposite sides of one of said pair of contacting portions are in line with opposite sides of the other contacting portion respectively.

7. The electrical connector as described in claim 1, wherein the insulative housing comprises a top surface and a bottom surface opposite to the top surface, and the bottom surface comprises a plurality of passageways and the contacts are received in the corresponding passageways respectively.

8. The electrical connector as described in claim 7, wherein the passageways each comprise a receiving space and a slot connecting with the receiving space, and the arms are received in the receiving space.

9. The electrical connector as described in claim 8, wherein the base portion comprises a pair of barbs received in the slot and interferenced with the insulative housing.

10. An electrical connector for use with an IC package, comprising:

an insulative housing; and a plurality of contacts received in the insulative housing, the contacts each comprising a base portion defining a first plane, a pair of arms extending upwardly from a top end of the base portion and a solder portion extending downwardly from a bottom end of the base portion, each arm comprising a bending portion bending from the base portion, a twist portion twisting from the bending portion and a contacting portion connecting with the twist portion, the twist portion being formed by rotating the arms around a vertical axis and there formed an angle between the twist portion and the base portion from a side view.

11. The electrical connector as described in claim 10, wherein the two arms are formed by split a metal sheet to two parts and then are bent to opposite directions.

12. The electrical connector as described in claim 10, wherein the bottom side of the twist portion is paralleled with the base portion and the top side of the twist portion is paralleled with the contact portion, wherein the top side of the twist portion and the bottom side thereof formed an acute angle.

13. The electrical connector as described in claim 10, wherein each arm comprising a bending portion extending curvedly from the base portion and a twist portion extending upwardly from the bending portion, wherein the contacting portion connects the twist portion.

14. The electrical connector as described in claim 10, wherein opposite sides of one contacting portion are in line with opposite sides of the other contacting portion, respectively.

15. An electrical connector comprising:

an insulative housing defining a plurality of passageways;

a plurality of contacts disposed in the corresponding passageways, respectively, each of said contacts defining a planar retention section, a solder portion extending from a lower part of the retention section, and a pair of spring arms extending side by side from an upper part of the retention section, each of said spring arms defining a transversely extending section extending from the retention section but transversely away from the retention section in a top view and opposite to the transversely extending section of the other of said spring arms, and a curved upwardly extending contacting section upwardly extending from the transversely extending section and is twisted about a vertical axis in a twisting direction which is one of a clockwise and a counterclockwise directions, wherein the twisting direction of one of the spring arms is same with that of the other one.

16. The electrical connector as claimed in claim 15, wherein a twisted angle of each of spring arms is same with each other.

17. The electrical connector as claimed in claim 16, wherein a twisted angle of each of spring arms is less than ninety degrees.

18. The electrical connector as claimed in claim 17, wherein the twisted angle of each of spring arms is less than forty-five degrees.

19. The electrical connector as claimed in claim 15, wherein the pair of spring arm is symmetric with each other with regard to an oblique line defining an angle with regard to the retention section, and said angle is also a twisted angle by each of spring arms.

20. The electrical connector as claimed in claim 15, wherein in the top view, the solder portion and one of the spring arms are located by one side of the corresponding retention section while the other spring arm is located by the other side.

* * * * *